US006031495A

United States Patent [19]

Simmons et al.

[11] Patent Number: 6,031,495

[45] Date of Patent: Feb. 29, 2000

[54] ANTENNA SYSTEM FOR REDUCING SPECIFIC ABSORPTION RATES

[75] Inventors: Kenneth D. Simmons; Jonathan L. Sullivan; Frank Hamma; Blake Winter, all of Lincoln, Nebr.

[73] Assignee: Centurion Intl., Inc., Lincoln, Nebr.

[21] Appl. No.: 08/886,948

[22] Filed: Jul. 2, 1997

[51] Int. Cl.[7] ..... H01Q 1/24

[52] U.S. Cl. ..... 343/702; 343/700 MS; 343/872; 343/841; 343/793; 343/846; 343/888; 343/901; 343/906; 455/90; 455/89

[58] Field of Search ..... 343/702, 700 MS, 343/841, 793, 810; 455/90, 89

[56] References Cited

U.S. PATENT DOCUMENTS

| | | | |
|---|---|---|---|
| 3,803,627 | 4/1974 | Schuscheng | 343/903 |
| 4,205,319 | 5/1980 | Gasparaitis et al. | 343/792 |
| 4,760,401 | 7/1988 | Imazeki | 343/702 |
| 4,772,895 | 9/1988 | Garay et al. | 343/895 |
| 4,849,767 | 7/1989 | Naitou | 343/745 |
| 4,867,698 | 9/1989 | Griffiths | 439/317 |
| 5,079,558 | 1/1992 | Koike | 343/702 |
| 5,177,492 | 1/1993 | Tomura et al. | 343/702 |
| 5,204,687 | 4/1993 | Elliott et al. | 343/702 |
| 5,245,350 | 9/1993 | Sroka | 343/702 |
| 5,300,940 | 4/1994 | Simmons | 343/749 |
| 5,317,325 | 5/1994 | Bottemley | 343/702 |
| 5,353,036 | 10/1994 | Baldry | 343/702 |
| 5,374,937 | 12/1994 | Tsunekawa et al. | 343/702 |
| 5,446,469 | 8/1995 | Makino | 343/702 |
| 5,467,096 | 11/1995 | Takamoro et al. | 343/702 |
| 5,469,177 | 11/1995 | Rush et al. | 343/702 |
| 5,479,178 | 12/1995 | Ha | 343/702 |
| 5,550,552 | 8/1996 | Oxley | 343/702 |
| 5,594,455 | 1/1997 | Hori et al. | 343/700 MS |
| 5,594,457 | 1/1997 | Wingo | 343/702 |
| 5,646,635 | 7/1997 | Cockson et al. | 343/702 |
| 5,659,889 | 8/1997 | Cockson | 455/575 |
| 5,666,125 | 9/1997 | Luxon et al. | 343/702 |
| 5,787,340 | 7/1998 | Sepponen | 455/90 |

FOREIGN PATENT DOCUMENTS

| | | |
|---|---|---|
| 3245603 | 11/1991 | Japan . |
| 685519 | 3/1994 | Japan . |
| 6252621 | 9/1994 | Japan . |

OTHER PUBLICATIONS

Doug DeMaw "Lightweight Trap Antennas—Some Thoughts", pp. 15–18, Jun. 1983.

*Primary Examiner*—Robert H. Kim
*Assistant Examiner*—Layla G. Lauchman
*Attorney, Agent, or Firm*—Zarley, McKee, Thomte, Voorhees & Sease; Dennis L. Thomte

[57] ABSTRACT

An antenna is provided for a wireless communication device such as a handheld radio or cellular telephone. The antenna may be either embedded internally in the transceiver or may be mounted externally thereof. The antenna comprises a pair of ¼ wave radiating elements which are coupled out of phase to create an end fire bi-directional pattern for the antenna. The radiating elements are attached to a micro-strip transmission phasing device which is comprised of a center conductor, a ground plane and a substrate material. The micro-strip transmission phasing device supplies a zero degree to one hundred eighty degree phase shift from one radiating element to the other radiating element.

18 Claims, 1 Drawing Sheet

ANTENNA SYSTEM FOR REDUCING SPECIFIC ABSORPTION RATES

BACKGROUND OF THE INVENTION

1. Field of the Invention

This invention relates to an antenna system for handheld radios, cellular telephones and other portable wireless communication devices with the antenna system being designed to direct potentially harmful electromagnetic energy away from the user's body.

2. Description of the Prior Art

Wireless communication has become extremely popular with the use of cellular telephones and other wireless devices. However, questions have arisen concerning the possibility of harmful effects of electromagnetic energy on the human body inasmuch as handheld radios, cellular telephones and other portable wireless communication devices do emit electromagnetic energy. Many studies have been conducted to closely examine the effects of electromagnetic energy on the human body to determine a safe level of exposure and how to accurately measure the level. In conjunction with this, there have been some attempts to move the source of electromagnetic energy away from the body by means of the antenna location or design. For example, see U.S. Pat. Nos. 5,335,366; 5,336,896; 5,338,896; 5,231,407; and, French Patent 2679086.

SUMMARY OF THE INVENTION

The antenna system of this invention is designed to tailor the radiation characteristics of the antenna in such a way as to decrease the specific absorption rates (SAR) to the user of the wireless communication device and to enhance the performance of the antenna's information gathering ability. Specifically, this is accomplished by phasing two radiating elements thereby creating an end fire bi-directional pattern. This end fire bi-directional pattern provides a high RF attenuation of approximately 20 db perpendicular to the user's head, with the bi-directional patterns being approximately 80 degrees wide at the half power points with no loss of signal compared to an omni-directional antenna. The broad-side gain ranges from 2–3 dB, with the antenna design easily being able to achieve VSWR's less than 2.5:1 over wireless frequency bands by property adjusting a matching network accordingly. The antenna system of this invention consists of two ¼ wave elements, a micro-strip feed line, and a matching network if needed. The radiating elements are constructed of either flexible cable, helical wound coils, meandering conductive strips, or telescopic conductors while the antenna's feed consists of a heavily loaded micro-strip feed line providing proper phasing to the two antenna elements to reduce antenna packaging. The antenna of this invention may be attached to the outside of the device or built internally in the device. Further, the antenna may be placed in the battery pack of the device or in the plastic housing that covers the internal components. Further, the antenna of this invention may be placed in the "flip" that covers the key pad. The antenna system may be molded into the device or may be a separate part that is attached by some other means.

Therefore, it is a principal object of the invention to provide an antenna system for reducing specific absorption rates.

Still another object of the invention is to provide an antenna system which not only reduces specific absorption rates, but also enhances the performance of the antenna's informational gathering ability.

Still another object of the invention is to provide an antenna system which offers a high RF attenuation typically 20 dB perpendicular to the user's head with the bi-directional patterns being approximately 80 degrees wide.

Still another object of the invention is to provide an antenna system which may be attached to the outside of the wireless device or built internally to the wireless device.

Still another object of the invention is to provide an antenna system which may be placed in the battery pack of the device or in the plastic housing that covers the internal components of the device.

Yet another object of the invention is to provide an antenna system which may be placed in the "flip" that covers the key pad of the wireless device.

Still another object of the invention is to provide an antenna system which may be molded into the wireless device or may be a separate part that is attached to the wireless device by some other means.

These and other objects of the present invention will be apparent to those skilled in the art.

DESCRIPTION OF THE PREFERRED EMBODIMENT

Figure 1:
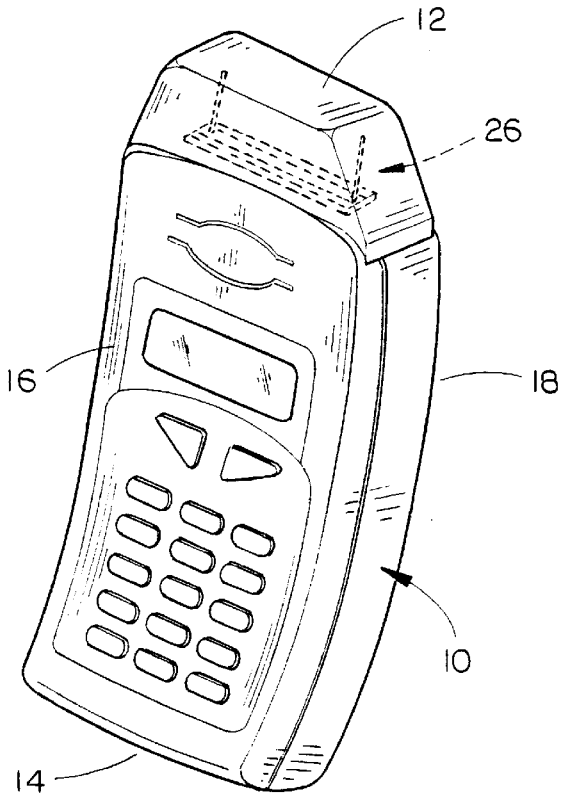
FIG. 1 is a perspective view of one type of telephone having the antenna system of this invention associated therewith.

The numeral 10 refers generally to a conventional cellular telephone having an upper end 12, lower end 14, front portion 16 and back portion 18. The numeral 20 refers to a conventional "flip" cellular telephone having a "flip" portion 22 which is designed to cover the key pad 24 at times. Although the drawings illustrate cellular telephones, the antenna system of this invention is suitable for use with any wireless communication device such as handheld radios, cellular telephones and other portable wireless communication devices that emit electromagnetic radiation (EMR).

The antenna system of this invention is referred to generally by the reference numeral 26 including a pair of antenna radiating elements 28 and 30 which may be constructed of electrically conductive materials such as flexible cable, helical wound coils, meandering conductive strips, telescopic conductors or other types of electrical conductor. The electrical length of radiating elements 28 and 30 are ¼ wave length of the frequency at which the antenna will resonate. The mechanical length of the radiating elements 28 and 30 is dependent upon several variables such as material composition, plating of the metal, etc. The radiating elements 28 and 30 are attached to a micro-strip transmission phasing device referred to generally by the reference numeral 32. The micro-strip transmission phasing device consists of three components, a center conductor 34, ground plane 36, and a substrate material 38. The function of the micro-strip transmission phasing device is to supply a zero degree to one hundred eighty degree phase shift from radiating element 28 to radiating element 30.

The center conductor 34 is constructed from an electrically conductive material such as copper, tin, silver, etc. The width of the center conductor 34 is determined by the desired characteristic impedance of the application. The thickness of the center conductor is dependent upon the electrical properties of the conductor material and may also be related to skin depth requirements for a given frequency. The length of the center conductor 34 is ½ wave length within the dielectric material.

The purpose of the ground plane 36 is to confine the electric field. The width of the ground plane 36 is typically calculated as a function of width of the center conductor 34. The thickness of the ground plane 36 is dependent upon the electrical properties of the center conductor 34 and is also related to skin depth requirements for a given frequency.

The role of the substrate material 38 is two-fold. The substrate material 38 is used to control the bandwidth performance of the transmission phasing device and provides electrical loading thereby reducing the physical size of the antenna system. The substrate material 38 may be made from several different materials such as Teflon, plastic, air, ceramic, etc., or a combination thereof. The thickness of the substrate material 38, the width of the center conductor 34, and the width of the ground plane 36 determine the intrinsic impedance of the micro-strip phasing transmission line and, in turn, result in the bandwidth of the device.

The RF signal is fed to the antenna 26 by attaching a conductive line from the transceiver of the wireless communication device to the antenna's RF feed point 40. A variety of feeding mechanisms such as coaxial cable, flexible stripline, or direct solder contact to the transceiver circuitry may be employed. The size and type of line and connection is dependent upon the application for which the antenna will be used.

Figure 2:
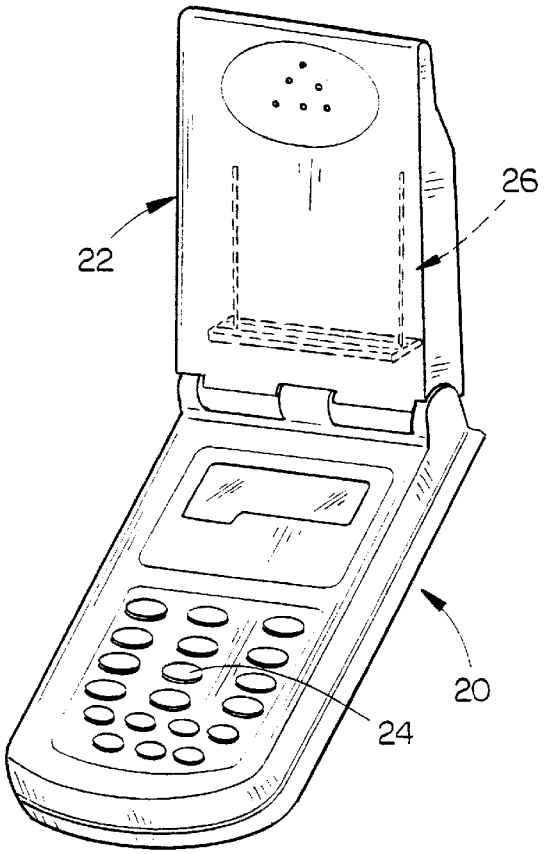
FIG. 2 is a perspective view of a different form of cellular telephone having the antenna system of this invention associated therewith.
Figure 3:
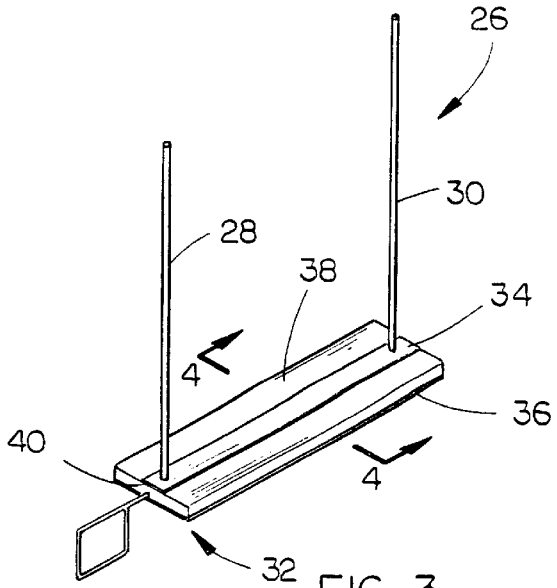
FIG. 3 is a perspective view of the antenna system of this invention.
Figure 4:
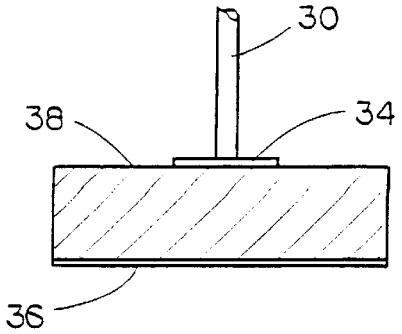
FIG. 4 is a sectional view seen on lines 4—4 of FIG. 3.

In operation, the RF signal is fed to the antenna through the feed point 40. The micro-strip transmission phasing device 32 supplies a zero degree to one hundred eighty degree phase shift from radiating element 28 to radiating element 30, thereby creating and end fire bi-directional pattern. The bi-directional pattern of this invention offers a high RF attenuation typically 20 db perpendicular to the user's head, with the bi-directional pattern being approximately 80 degrees wide at the half-power points with no loss of signal compared to an omni-directional antenna. The broad-side gain ranges from 2–3 dB. The antenna design of this invention can easily achieve less than 2.5:1 VSWR over wireless frequency bands by properly adjusting a matching network, if necessary. The antenna of this invention may be mounted in the upper end of the telephone 10, as illustrated in FIG. 1, or it may be embedded in the "flip" portion 22 of the cellular telephone 20, as illustrated in FIG. 2. The antenna may also be placed on the outside of the device or built internally, as illustrated in FIGS. 1 and 2. The antenna system of this invention may also be placed in the battery pack of the telephone or in the plastic housing that covers the internal components.

The bi-directional pattern of the antenna system of this invention substantially decreases SAR to the user, but does not degrade the electrical performance of the antenna or increase the overall size of the antenna/transceiver.

Thus it can be seen that the invention accomplishes at least all of its stated objectives.

We claim:

1. A bi-directional antenna for a portable wireless communication device including RF circuitry, comprising:

a substantially flat transmission phasing device having opposite ends and including at ground plane, a substrate material on said ground plane, and an elongated conductor, having opposite ends, on said substrate material;

a first antenna radiating element RF connected to one end of said elongated conductor and extending substantially transversely therefrom;

a second antenna radiating element RF connected to the other end of said elongated conductor and extending substantially transversely therefrom;

said elongated conductor being adapted to be RF connected to the RF circuitry of the portable communication device.

2. The antenna of claim 1 wherein said antenna is positioned within the wireless communication device.

3. The antenna of claim 1 wherein said antenna is positioned externally on said wireless communication device.

4. The antenna of claim 1 wherein said transmission phasing device and said antenna radiating elements are arranged so as to substantially eliminate any omni-directional radiation pattern.

5. The antenna of claim 1 wherein each of said antenna radiating elements comprises a ¼ wave radiating element and wherein said conductor is ½ wave length.

6. The antenna of claim 1 wherein said flat transmission phasing device includes upper and lower ends and wherein said ground plane is positioned at the bottom of said transmission phasing device to confine the electric field of the antenna, said substrate material being positioned on said ground plane, said conductor comprising a center conductor positioned on said substrate material having a RF feed point thereon.

7. The antenna of claim 6 wherein said RF feed point is provided at one end of said center conductor.

8. The antenna of claim 6 wherein said center conductor has a width which is dependent upon the desired characteristic impedance of the antenna.

9. The antenna of claim 6 wherein said ground plane has a width which is a multiple of the width of said center conductor.

10. The antenna of claim 1 wherein each of said first and second antenna radiating elements comprises a flexible cable.

11. The antenna of claim 1 wherein each of said first and second antenna radiating elements comprises a helical wound coil.

12. The antenna of claim 1 wherein each of said first and second antenna radiating elements comprises a meandering conductive strip.

13. The antenna of claim 1 wherein each of said first and second antenna radiating elements comprises a telescopic conductor.

14. The antenna of claim 1 wherein said transmission phasing device comprises a micro-strip assembly.

15. In combination:

a wireless communication device including an antenna associated therewith which directs electromagnetic radiation away from the user's body;

said antenna being configured so as to eliminate omni-directional radiation therefrom.

16. The combination of claim 15 wherein said antenna is positioned within said wireless communication device.

17. The combination of claim 15 wherein said antenna is mounted on said wireless communication device.

18. In combination:

a wireless communication device including an antenna associated therewith which directs electromagnetic radiation away from the user's body;

a substantially flat transmission phasing device having opposite ends and including a ground plane, a substrate material on said ground plane, and an elongated conductor, having opposite ends, on said substrate material;

a first antenna radiating element RF connected to one end of said elongated conductor and extending substantially transversely therefrom;

a second antenna radiating element RF connected to the other end of said elongated conductor and extending substantially transversely therefrom;

said elongated conductor being adapted to be RF connected to the RF circuitry of the portable communication device.

* * * * *